US006257250B1

(12) United States Patent
Sartena

(10) Patent No.: US 6,257,250 B1
(45) **Date of Patent: *Jul. 10, 2001**

(54) HAIR FASHION ACCESSORY

(75) Inventor: Stacey Eve Sartena, Great Neck, NY (US)

(73) Assignee: Hair Blast, Inc., Great Neck, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/505,405

(22) Filed: Feb. 16, 2000

(51) Int. Cl.[7] ..... A45D 8/12; A45D 8/20; A41G 3/00

(52) U.S. Cl. ..... 132/275; 132/277; 132/53

(58) Field of Search ..... 132/53, 54, 55, 132/56, 277, 273, 275, 276, 278, 279; D28/25, 29, 32, 33, 40–43

(56) References Cited

U.S. PATENT DOCUMENTS

| | | | |
|---|---|---|---|
| 250,967 | 12/1881 | Presser . | |
| D. 261,181 | 10/1981 | Sands | D28/32 |
| D. 335,390 | 5/1993 | Yim | D2/500 |
| D. 356,398 | 3/1995 | Hafid | D28/92 |
| D. 381,119 | 7/1997 | Chang | D28/40 |
| D. 381,767 | 7/1997 | Chang | D28/40 |
| D. 384,786 | 10/1997 | LaFauci | D2/501 |
| 566,779 | 9/1896 | Liebreich . | |
| 731,575 | 6/1903 | Johnston . | |
| 768,658 | 8/1904 | Dongille . | |
| 794,479 | 7/1905 | Austin . | |
| 1,346,718 | 7/1920 | Muller . | |
| 1,526,440 | 2/1925 | Skaruda . | |
| 1,594,741 | 8/1926 | Lewis . | |
| 1,714,358 | 5/1929 | Finkelstein . | |
| 2,620,809 | 12/1952 | Rosen . | |
| 2,651,310 | 9/1953 | Selson . | |
| 2,849,007 | 8/1958 | Behr . | |
| 3,280,826 | 10/1966 | Jenkins . | |
| 3,659,622 | 5/1972 | Meerson . | |
| 4,254,783 | 3/1981 | Kim . | |
| 4,998,186 | 3/1991 | Cocca . | |
| 5,441,061 | 8/1995 | Jordan et al. | 132/275 |
| 5,549,127 | 8/1996 | Chang | 132/277 |
| 5,732,720 | 3/1998 | Sears . | |
| 5,803,096 | 9/1998 | Lee | 132/277 |

(List continued on next page.)

FOREIGN PATENT DOCUMENTS

| | | |
|---|---|---|
| 126305 | 6/1927 | (CH) . |
| 135892 | 12/1929 | (CH) . |
| 362668 | 8/1962 | (CH) . |

(List continued on next page.)

*Primary Examiner*—John J. Wilson
*Assistant Examiner*—Robyn Kieu Doan
(74) *Attorney, Agent, or Firm*—Schweitzer Cornman Gross & Bondell LLP

(57) ABSTRACT

A fashion hair accessory comprises a claw type hair clip formed by hinged-together clip elements with interleaved tines, combined with strip sections of artificial hair. The strip sections of hair are formed with selvage-like margins at one end which are adhered to side walls of the clip elements adjacent to the tines. The selvage-like margins are secured alternatively to inside or outside walls of the clip elements, or optionally both inside and outside. Where margins are secured to inside walls, the strands of hair are guided outwardly through spaces between tines of the clip elements. The clip elements are joined along a hinge axis and have gripping elements on the side of said axis opposite from the tines. The strands of hair are guided over external surfaces of the clip elements, in a direction from the tines toward and beyond gripping elements, and the strands are convergently gathered in the region of, and typically but not necessarily beyond, said gripping elements. A strikingly attractive accessory is achieved, which may be inexpensively produced at low cost.

7 Claims, 6 Drawing Sheets

U.S. PATENT DOCUMENTS

| | | | |
|---|---|---|---|
| 5,826,593 | 10/1998 | Haubrich . | |
| 5,873,377 | 2/1999 | Yang | 132/277 |
| 5,890,498 | 4/1999 | Kawaguchi | 132/275 |
| 5,947,129 | 9/1999 | Bradshaw . | |
| 6,047,708 | 4/2000 | Panel et al. . | |

FOREIGN PATENT DOCUMENTS

| | | |
|---|---|---|
| 6823 | 7/1904 | (DK) . |
| 421964 | 10/1910 | (FR) . |
| 460804 | 12/1913 | (FR) . |
| 540368 | 7/1922 | (FR) . |
| 23134 | 10/1897 | (GB) . |

FIG. 1
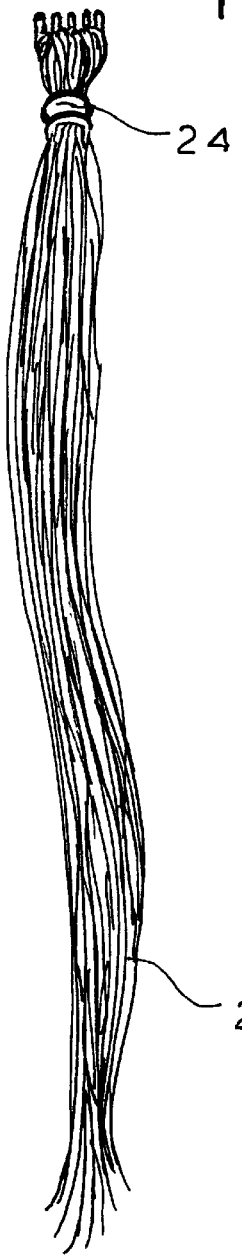
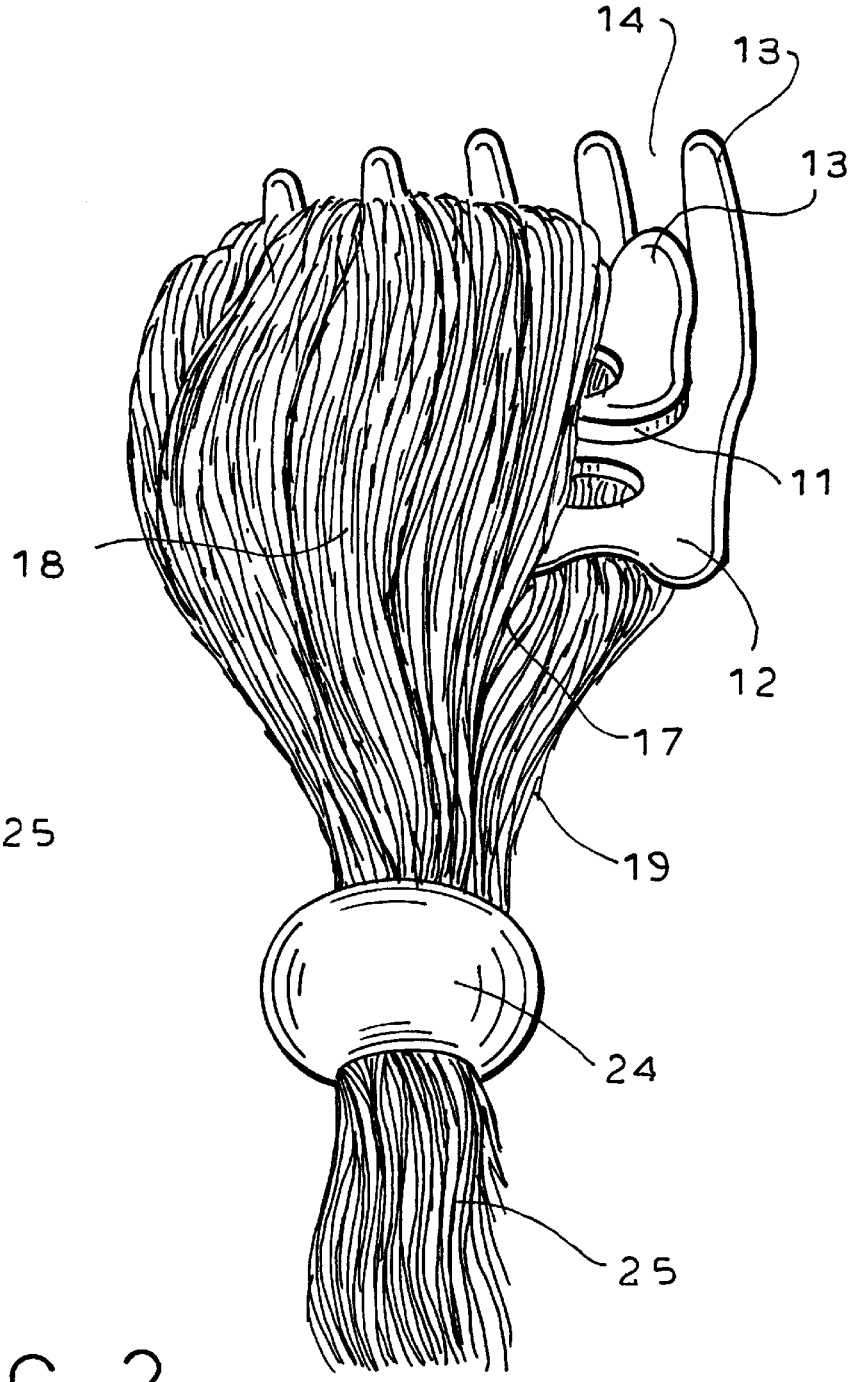
FIG. 2

HAIR FASHION ACCESSORY

RELATED APPLICATIONS

This application is related to my co-pending applications Ser. No. 09/441,227, filed Nov. 15, 1999, and Ser. No. 09/497,098, filed Feb. 3, 2000.

BACKGROUND AND SUMMARY OF THE INVENTION

The present invention relates to hair accessories, and more particularly to such an accessory that comprises a claw-type hair clip combined in a novel and unique manner with strip sections of artificial hair to form an unusually attractive fashion accessory.

My co-pending applications disclose hair accessories in which strip sections of artificial hair are secured at one end to interior walls of claw-type hair clips, with the hair, in braided or strand form, being directed to the exterior of the clip through spaces between tines, end openings in the clip, and/or from the back or hinge area of the clip, and allowed to fall away from the clip. The clip itself is largely visible when worn.

In the accessory device of the present invention strip sections hair are secured to the body of the clip, either inside or outside of the clip body, and the strands of hair are led from the area of the tines, over the outer body and gripping elements of the clip, and are convergently gathered. In one embodiment, the hair strands are gathered in a region spaced away from the clip, typically relatively near the gripping elements thereof. In another embodiment, the hair strands are convergently gathered around the body of the clip, in a necked-down region thereof adjacent the gripping elements.

The device of the invention can be inexpensively manufactured for readily available components, and provides an unusually attractive fashion adornment.

For a more complete understanding of the above and other features and advantages of the invention, reference should be made to the following detailed description of preferred embodiments thereof and to the accompanying drawings.

DESCRIPTION OF THE DRAWINGS

FIG. 1 is a side elevational view of the hair accessory device of the invention.

FIG. 2 is an enlarged, fragmentary perspective view of the device of FIG. 1.

DESCRIPTION OF PREFERRED EMBODIMENTS

Figure 3:
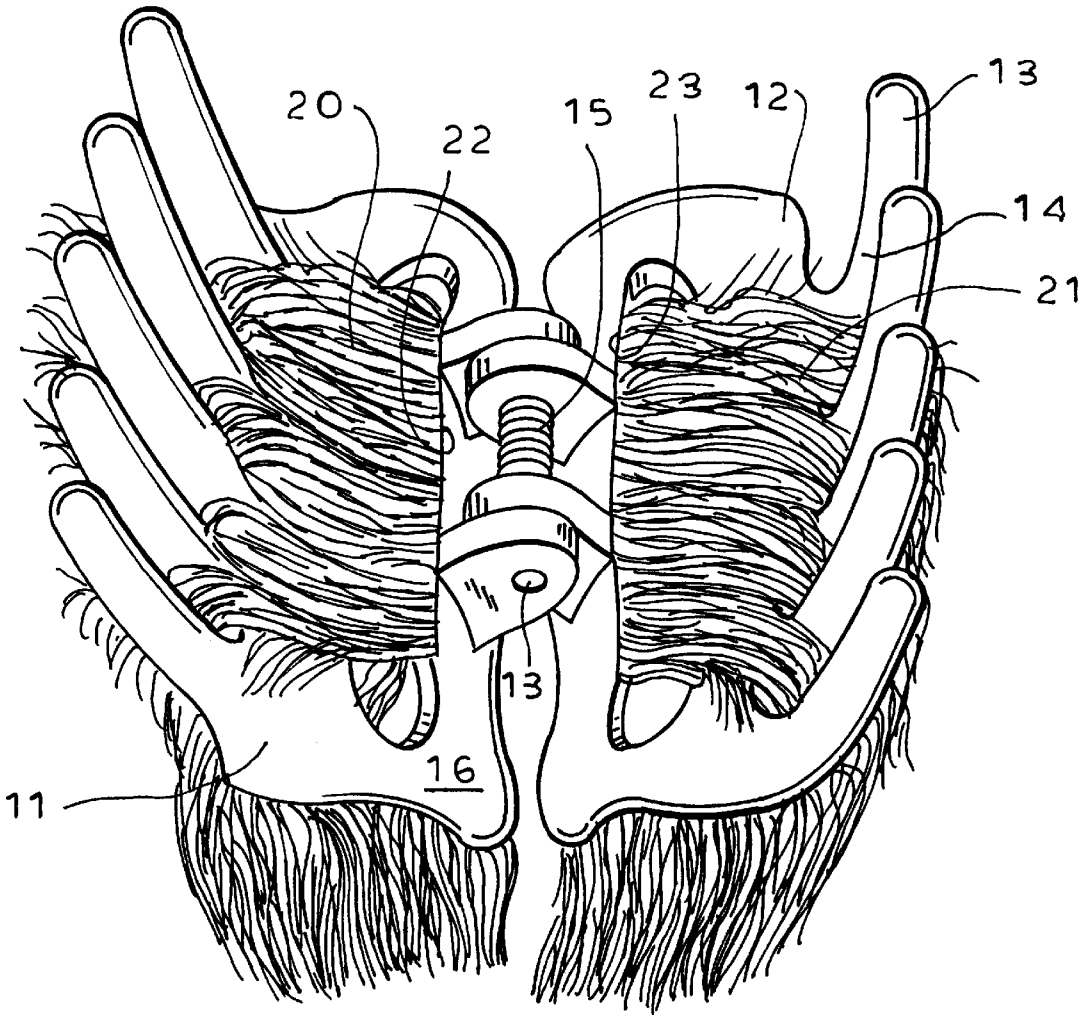
FIG. 3 is an enlarged, fragmentary top perspective view of the device of FIG. 1, showing the clip in opened position to reveal the interior.
Figure 4:
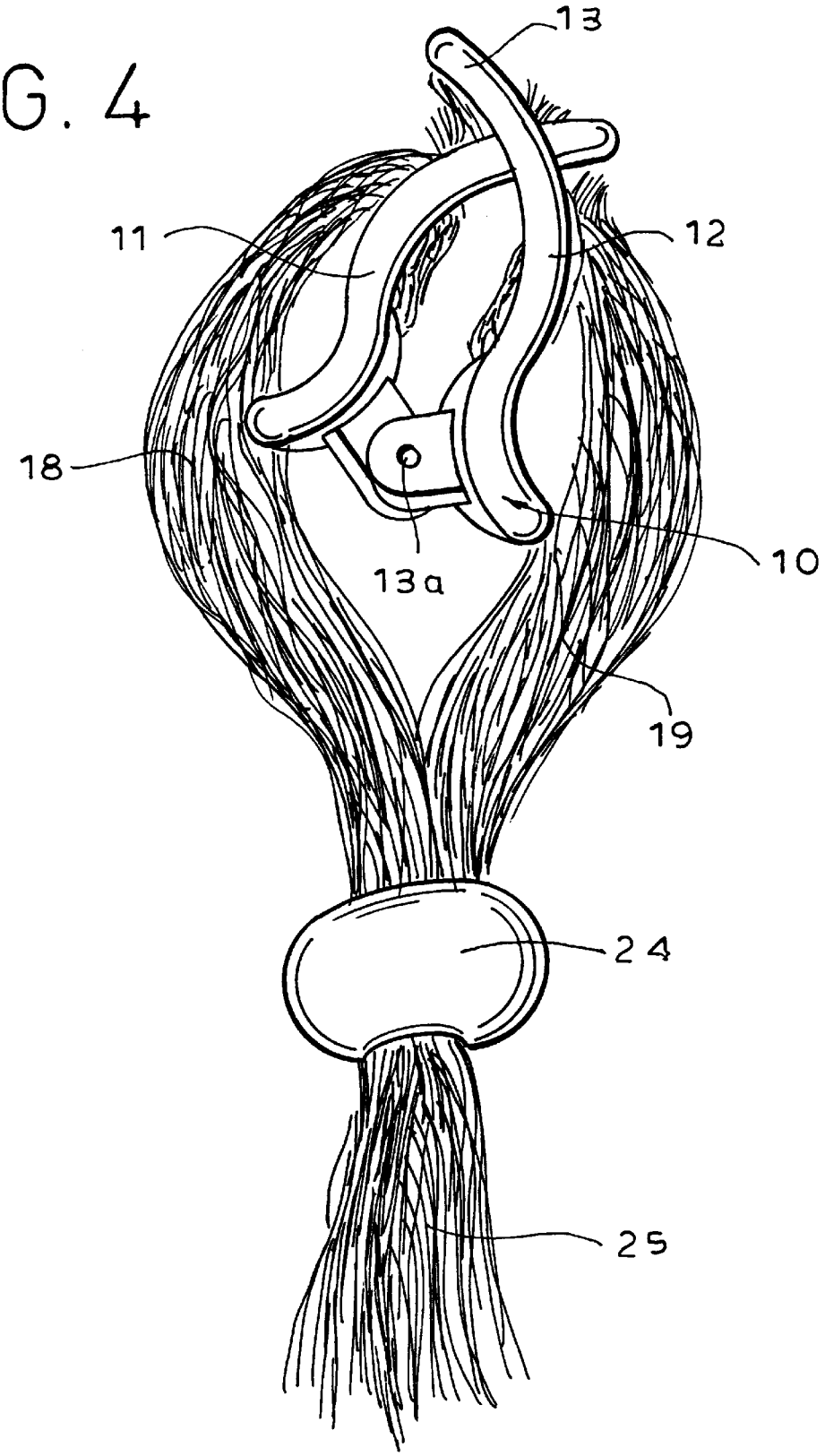
FIG. 4 is an enlarged, fragmentary end elevational view of the device of FIG. 1.

Referring now to the drawings, and initially to FIGS. 1–5 thereof, the reference numeral 10 designates generally a claw-type hair clip of a commercially available type. The clip 10 comprises first and second clip elements 11, 12, joined together by a hinge pin 13*a*. Each of the clip elements is formed with a plurality of tines 13 separated by spaces 14. The spaces 14 are of a size, and the alignment of the respective clip elements 11, 12 is such that, when the clip is in a closed position, shown in FIGS. 1 and 2, the tines 14 of one clip element are received in the spaces between tines of the other element. A spring 15 engages the two clip elements and urges them to the normally closed position.

The Chang U.S. Pat. No. 5,549,127 is representative of a typical form of claw-type hair clip suitable for use in the present invention, and the disclosure thereof is incorporated by reference.

Each of the clip elements 11, 12 is provided with a gripping element 16, 17 (see FIGS. 2 and 3) on the opposite side of the hinge axis from the tines. By squeezing the two gripping elements toward each other, the clip can be open to a position, such as shown in FIG. 3, to enable the clip to be inserted into the user's hair.

The device of the invention utilizes strip sections of artificial hair in conjunction with the clip device. The strip sections of hair (natural or synthetic) are available commercially and consist of strands of hair laid side by side and secured together along one end by suitable means, typically a line of stitching similar to the selvage formed along the edge of a woven fabric, for example. Artificial hair produced in this manner is available in units of substantial width (e.g., two or more feet) and is separated into individual strip sections of desired narrower width by simply cutting through the selvage-like edge margin.

In the device of the present invention, two or more strip sections 19 are provided, cut to a width corresponding generally with the width of the clip device 10. The selvage-like edge 20, 21 of each strip section is then secured to the body of the clip, using a suitable adhesive. Within the contemplation of the invention, the selvage-like margins 20, 21 may be secured to the clip body, either on the inside walls 22, 23 of the clip, as shown in FIG. 3, or on the opposite or outside walls thereof, or both. In all cases, the edge margins 20, 21 typically will be secured in a region close to the base of the tines 13, with the edge margins oriented generally parallel to the hinge axis.

Pursuant to the invention, the individual hair strands of the strip sections 18, 19 are guided from the secured edge margins in a direction to pass over the outer walls of the clip device, including the gripping elements thereof, and are convergently gathered by means such as a ring 24. After passing through the gathering ring 24, the hair can be permitted to fall freely in a loose tail 25, giving an appearance similar to the pigtail and ponytail.

In the form of the invention shown in FIGS. 1–5, where the edge margins of the strip sections are secured to the inside walls of the clip, the strands of hair are led outward through the spaces 14 between tines and then immediately reversed in direction to pass over outer surfaces of the clip in the direction, sequentially, of the hinge axis and gripping elements, and beyond. In order to open and close the clip, the gripping elements 17, 18 are engaged through the hair passing thereover.

Figure 5:
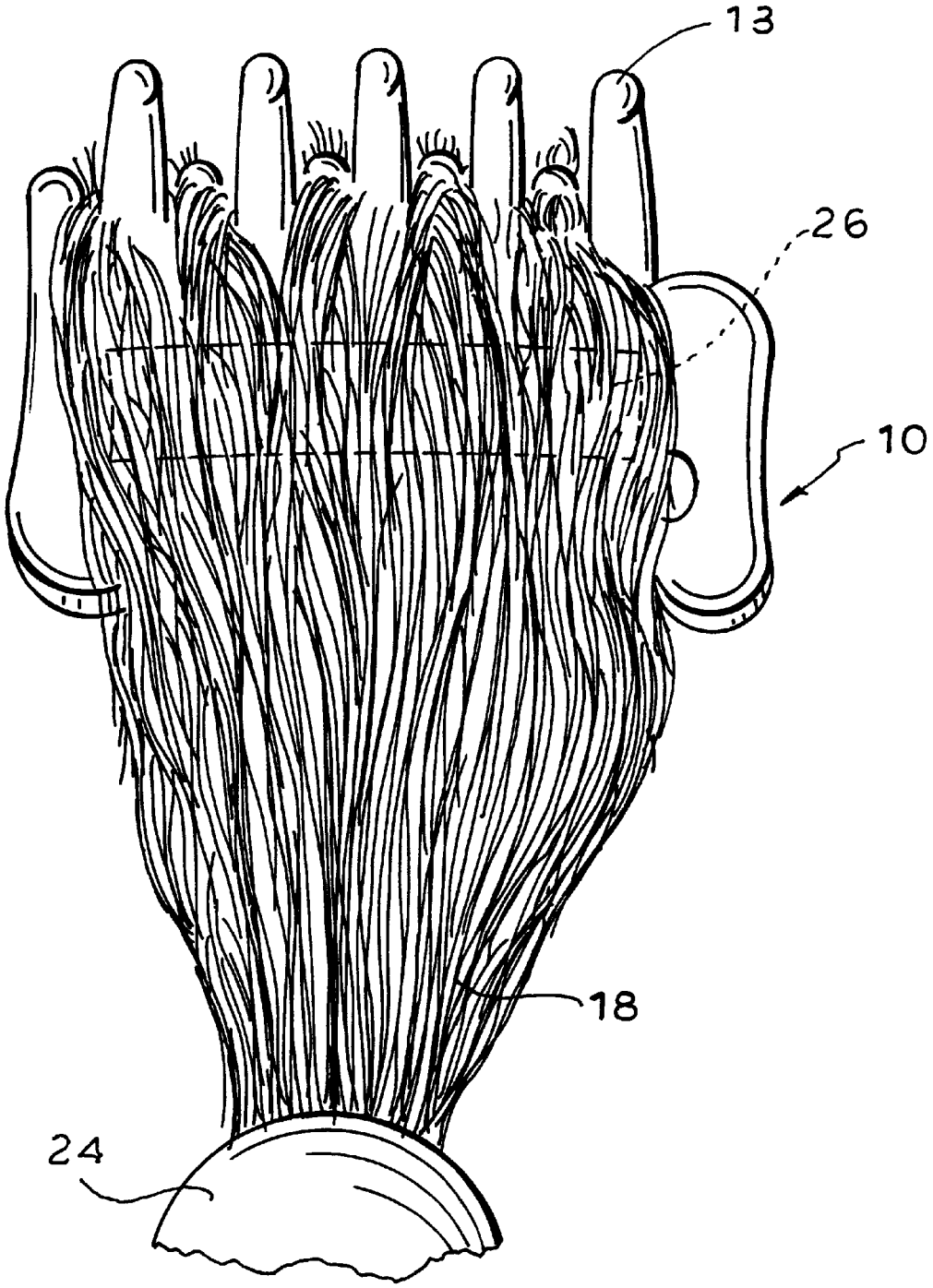
FIG. 5 is an enlarged, fragmentary side elevational view of the device of FIG. 1.

In a device such as shown in FIGS. 1–5, strip sections of hair may be secured by their selvage-like edge margins to outer surfaces of the clip, as indicated by dotted lines in FIG. 5, identified by the reference numeral 26. This may be in addition to, or in place of, strips secured to the inside walls of the clip in the manner shown in FIG. 3. The number of strip sections of hair utilized in connection with a single clip can be varied, depending upon the quantity of hair to be attached and the fashion effects sought to be achieved. At least two such strip sections will be employed, one on each side of the clip, and in general the strip sections will be utilized in corresponding pairs.

As is described in my earlier co-pending applications, the strip sections of hair can be obtained with the hair in the form of micro braids or the like, and in some cases it may be desirable to intersperse some braided strands. This can be done conveniently by incorporating short strip sections of braided strands together with sections of free strands.

Figure 6:
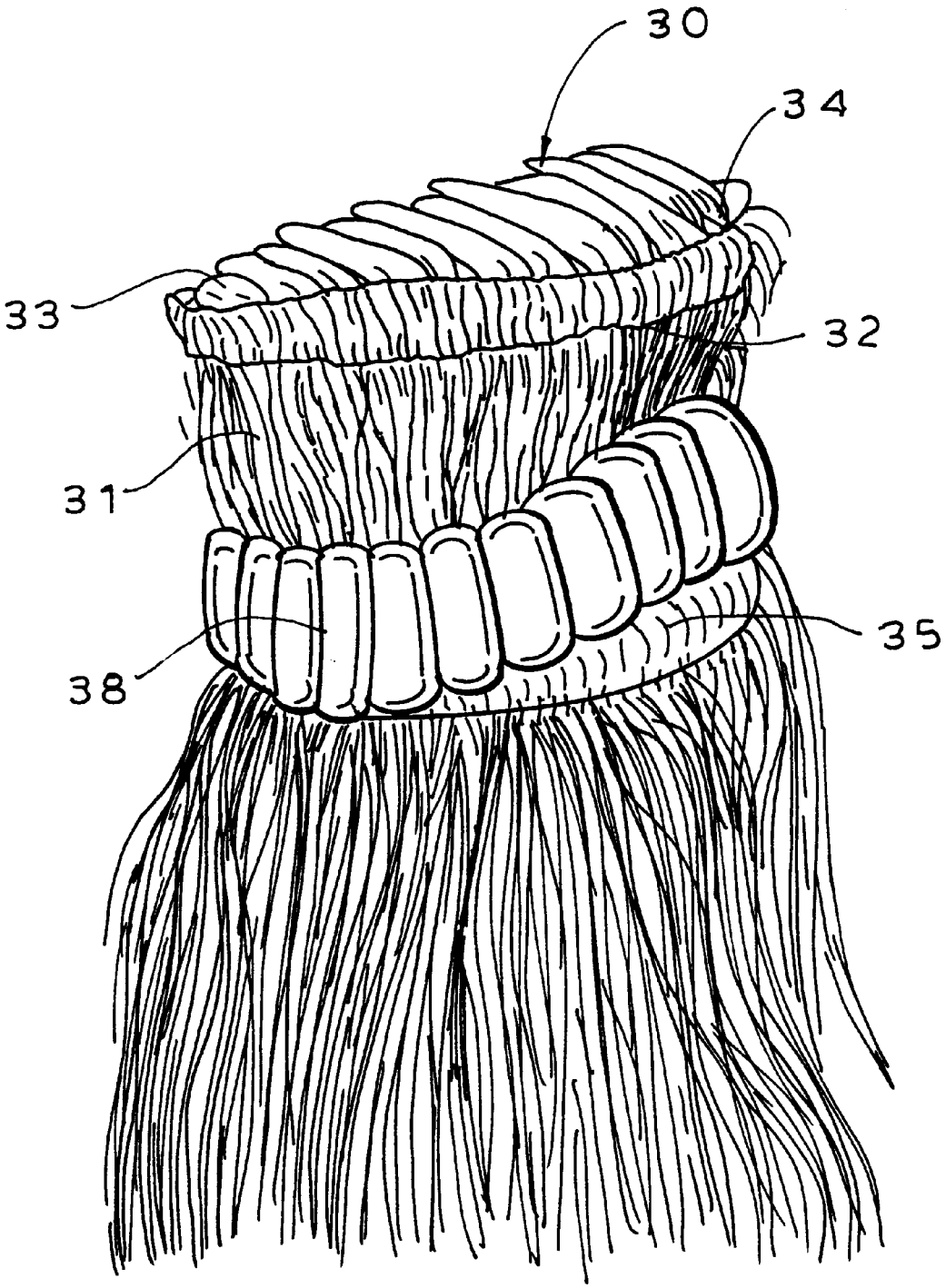
FIG. 6 is an enlarged, fragmentary side perspective view of a second embodiment of the invention.
Figure 7:
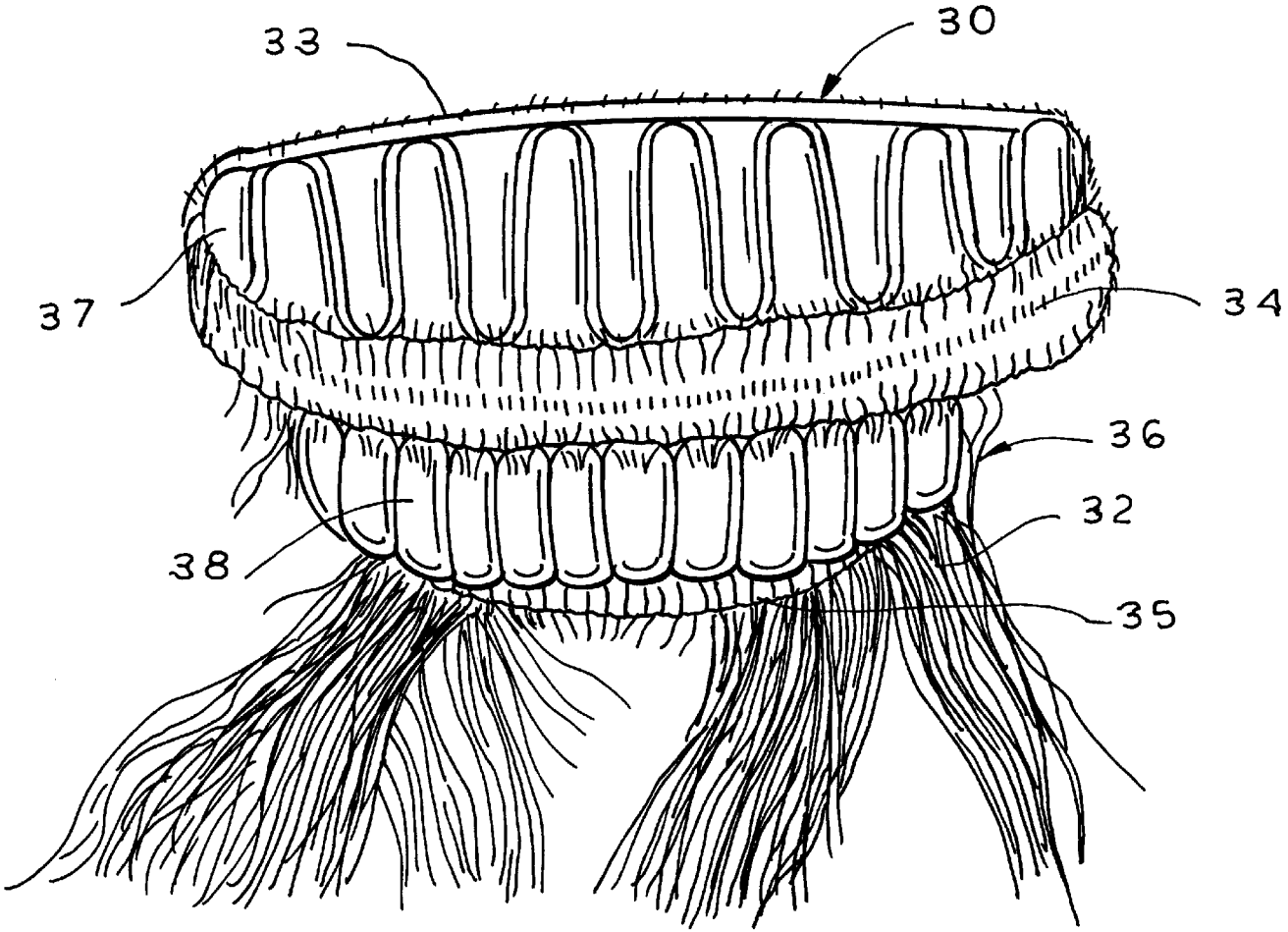
FIG. 7 is an enlarged, fragmentary top perspective view of the device of FIG. 6.

In the form of the invention shown in FIGS. 6 and 7, a claw-type clip device 30 is arranged with strip sections 31, 32 of hair secured by its selvage-like edge margins 33, 34 to outside walls of the clip device. The strip sections are oriented such that the strands of hair lead away from the edge margins in a direction to pass over the outer body of the clip and gripping elements 35 associated therewith. In the illustrated form of clip device 30, there is a somewhat narrowed waist region 36 between the main body 37 of the clip and its gripping elements 35 (this being a typical configuration of such clips) which allows the hair strands to be gathered in that waist region by means of an elastic band 38.

As in the case of the embodiment of FIGS. 1–5, the hair strands are led from the edge margins 33, 34 sequentially toward the hinge axis and gripping elements, and beyond. In the case of the embodiment of FIGS. 6 and 7, the hair is convergently gathered around the clip body, adjacent to the gripping elements, whereas in the embodiment of FIGS. 1–5, the hair is convergently gathered after it passes beyond the gripping elements.

The device of the invention can be inexpensively manufactured and marketed, and provides an unusually attractive, easy to use hair fashion accessory.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

I claim:

1. A hair accessory which comprises (a) a claw type hair clip having a pair of clip elements joined together along a hinge axis, (b) said clip elements having a plurality of interleaving tines on one side of said hinge axis, (c) said clip elements normally being urged by a spring to a closed position and having gripping elements on a second side of said hinge axis opposite said tines, (d) a plurality of strip sections of artificial hair, each such strip section comprising a plurality of strands of natural or synthetic hair arranged in side-by-side relation and joined at one end by a selvage-like edge margin, (e) a strip section of artificial hair being secured to each of said clip elements, with said selvage-like edge margins being positioned adjacent to said tines and aligned generally with said hinge axis and with the strands of hair being oriented generally at right angles thereto, (f) said strands of hair being guided over exterior surfaces of said clip elements toward and beyond said gripping elements thereof and being convergently gathered adjacent to said gripping elements.

2. A hair accessory according to claim 1, wherein (a) said strip sections of hair being secured by adhering said selvage-like margins to side walls of said clip elements adjacent to said tines.

3. A hair accessory according to claim 2, wherein (a) said selvage-like margins are secured to outer side walls of said clip elements.

4. A hair accessory according to claim 2, wherein (a) said selvage-like margins are secured to inner side walls of said clip elements, and (b) said strands of hair are directed outward of said clip elements through spaces between said tines and thereafter being directed over outer side walls of said clip elements toward and beyond said gripping elements.

5. A hair accessory according to claim 1, wherein (a) the gripping elements of said clip elements are joined integrally with adjacent portions of said clip elements by means of a neck area of reduced width in relation to body portions of said clip elements adjacent to said tines and to said gripping elements, and (a) said strands of hair are convergently gathered in said neck area.

6. A hair accessory according to claim 5, wherein (a) said strands of hair are convergently gathered by means of an elastic band surrounding said strands of hair in the region of said neck.

7. A hair accessory according to claim 1, wherein (a) said strands of hair are convergently gathered at a location on the opposite side of said gripping elements from said hinge axis.

* * * * *